US009752318B2

(12) United States Patent
Pilz

(10) Patent No.: US 9,752,318 B2
(45) Date of Patent: Sep. 5, 2017

(54) FIRE BLOCKING REVEAL

(71) Applicant: CALIFORNIA EXPANDED METAL PRODUCTS COMPANY, City of Industry, CA (US)

(72) Inventor: Don A. Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 14/997,291

(22) Filed: Jan. 15, 2016

(65) Prior Publication Data

US 2016/0208484 A1 Jul. 21, 2016

Related U.S. Application Data

(60) Provisional application No. 62/104,627, filed on Jan. 16, 2015.

(51) Int. Cl.

| | |
|---|---|
| ***E04B 1/94*** | (2006.01) |
| ***E04B 2/74*** | (2006.01) |
| ***E04F 13/00*** | (2006.01) |
| ***A62C 2/06*** | (2006.01) |

(52) U.S. Cl.

CPC ..... *E04B 2/7411* (2013.01); *A62C 2/065* (2013.01); *E04B 1/941* (2013.01); *E04B 1/948* (2013.01); *E04B 2/7409* (2013.01); *E04B 2/7457* (2013.01); *E04F 13/00* (2013.01); *E04B 1/947* (2013.01)

(58) Field of Classification Search

CPC ..... E04B 2/7411; E04B 1/948; E04B 1/947; E04B 1/94; E04B 1/941; E04B 2/7409; A62C 2/065

See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |
| 2,105,771 | A | 1/1938 | Holdsworth |

(Continued)

FOREIGN PATENT DOCUMENTS

| | | |
|---|---|---|
| CA | 2234347 | 10/1999 |
| CA | 2697295 | 12/2013 |

(Continued)

OTHER PUBLICATIONS

US 9,085,895, 07/2015, Pilz et al. (withdrawn)

(Continued)

*Primary Examiner* — Andrew J Triggs

(74) *Attorney, Agent, or Firm* — Knobbe, Martens, Olson & Bear LLP

(57) ABSTRACT

A fire-rated reveal piece and wall assemblies or other assemblies that incorporate the fire-rated reveal piece, in which the reveal piece can include an intumescent or other fire-resistant material strip. The reveal can be attached adjacent to a corner, flange or leg of a framing member, such as metal tracks, headers, header tracks, sill plates, bottom tracks, metal studs, wood studs or wall partitions, and placed between the framing member and a wall board member at a perimeter of a wall assembly to create a fire block arrangement. A fire spray material can be applied over a portion of the reveal piece.

16 Claims, 5 Drawing Sheets

(56) References Cited

U.S. PATENT DOCUMENTS 2,218,426 A 10/1940 Hulbert, Jr.
2,683,927 A 7/1954 Maronek
2,733,786 A 2/1956 Drake
3,129,792 A 4/1964 Gwynne
3,271,920 A 9/1966 Downing, Jr.
3,309,826 A 3/1967 Zinn
3,324,615 A 6/1967 Zinn
3,355,852 A 12/1967 Lally
3,397,495 A * 8/1968 Thompson ..... E04B 2/825 52/241
3,481,090 A 12/1969 Lizee
3,537,219 A 11/1970 Navarre
3,566,559 A 3/1971 Dickson
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,908,328 A 9/1975 Nelsson
3,934,066 A 1/1976 Murch
3,935,681 A 2/1976 Voiturier et al.
3,955,330 A 5/1976 Wendt
3,964,214 A 6/1976 Wendt
3,974,607 A 8/1976 Balinski
3,976,825 A 8/1976 Anderberg
4,011,704 A 3/1977 O'Konski
4,103,463 A 8/1978 Dixon
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,203,264 A 5/1980 Kiefer et al.
4,283,892 A 8/1981 Brown
4,318,253 A 3/1982 Wedel
4,329,820 A 5/1982 Wendt
4,361,994 A 12/1982 Carver
4,424,653 A 1/1984 Heinen
4,434,592 A 3/1984 Reneault et al.
4,437,274 A 3/1984 Slocum et al.
4,454,690 A 6/1984 Dixon
4,622,794 A 11/1986 Geortner
4,649,089 A 3/1987 Thwaites
4,672,785 A 6/1987 Salvo
4,709,517 A 12/1987 Mitchell et al.
4,711,183 A 12/1987 Handler et al.
4,723,385 A 2/1988 Kallstrom
4,761,927 A 8/1988 O'Keeffe et al.
4,787,767 A 11/1988 Wendt
4,805,364 A 2/1989 Smolik
4,825,610 A 5/1989 Gasteiger
4,845,904 A 7/1989 Menchetti
4,850,385 A 7/1989 Harbeke
4,885,884 A 12/1989 Schilger
4,918,761 A 4/1990 Harbeke
4,930,276 A 6/1990 Bawa et al.
5,010,702 A 4/1991 Daw et al.
5,094,780 A 3/1992 von Bonin
5,103,589 A 4/1992 Crawford
5,125,203 A 6/1992 Daw
5,127,203 A 7/1992 Paquette
5,127,760 A 7/1992 Brady
5,146,723 A 9/1992 Greenwood et al.
5,155,957 A 10/1992 Robertson et al.
5,157,883 A 10/1992 Meyer
5,167,876 A 12/1992 Lem et al.
5,173,515 A 12/1992 von Bonin et al.
5,212,914 A 5/1993 Martin et al.
5,222,335 A 6/1993 Petrecca
5,244,709 A 9/1993 Vanderstukken
5,285,615 A 2/1994 Gilmour
5,315,804 A 5/1994 Attalla
5,325,651 A 7/1994 Meyer et al.
5,347,780 A 9/1994 Richards et al.
5,367,850 A 11/1994 Nicholas
5,374,036 A 12/1994 Rogers et al.
5,376,429 A 12/1994 McGroarty
5,390,465 A 2/1995 Rajecki
5,394,665 A 3/1995 Johnson
5,412,919 A 5/1995 Pellock et al.
5,452,551 A 9/1995 Charland et al.
5,454,203 A 10/1995 Turner
5,456,050 A 10/1995 Ward
5,471,791 A 12/1995 Keller
5,471,805 A 12/1995 Becker
5,477,652 A 12/1995 Torrey et al.
5,552,185 A 9/1996 De Keyser
5,592,796 A 1/1997 Landers
5,604,024 A 2/1997 von Bonin
5,644,877 A 7/1997 Wood
5,687,538 A 11/1997 Frobosilo et al.
5,689,922 A 11/1997 Daudet
5,709,821 A 1/1998 von Bonin et al.
5,740,643 A 4/1998 Huntley
5,755,066 A 5/1998 Becker
5,765,332 A * 6/1998 Landin ..... E04B 1/948 52/235
5,787,651 A 8/1998 Horn et al.
5,797,233 A 8/1998 Hascall
5,806,261 A 9/1998 Huebner et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,950,385 A 9/1999 Herren
5,968,615 A 10/1999 Schlappa
5,968,669 A 10/1999 Liu et al.
5,974,750 A 11/1999 Landin et al.
5,974,753 A 11/1999 Hsu
6,058,668 A 5/2000 Herren
6,110,559 A 8/2000 De Keyser
6,128,874 A 10/2000 Olson et al.
6,131,352 A 10/2000 Barnes et al.
6,151,858 A 11/2000 Ruiz et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,305,133 B1 10/2001 Cornwall
6,374,558 B1 4/2002 Surowiecki
6,381,913 B2 5/2002 Herren
6,405,502 B1 6/2002 Cornwall
6,430,881 B1 8/2002 Daudet et al.
6,470,638 B1 * 10/2002 Larson ..... E04B 1/765 52/254
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,698,146 B2 3/2004 Morgan et al.
6,705,047 B2 3/2004 Yulkowski
6,732,481 B2 5/2004 Stahl, Sr.
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 3/2005 Stover
7,043,880 B2 5/2006 Morgan et al.
7,059,092 B2 6/2006 Harkins et al.
7,152,385 B2 12/2006 Morgan et al.
7,191,845 B2 3/2007 Loar
7,240,905 B1 7/2007 Stahl
7,251,918 B2 8/2007 Reif et al.
7,302,776 B2 12/2007 Duncan et al.

(56) References Cited

U.S. PATENT DOCUMENTS

| | | | | |
|---|---|---|---|---|
| 7,398,856 | B2 | 7/2008 | Foster et al. | |
| 7,413,024 | B1 | 8/2008 | Simontacchi et al. | |
| 7,487,591 | B2 | 2/2009 | Harkins et al. | |
| 7,506,478 | B2 | 3/2009 | Bobenhausen | |
| 7,513,082 | B2 | 4/2009 | Johnson | |
| 7,540,118 | B2 | 6/2009 | Jensen | |
| 7,617,643 | B2 | 11/2009 | Pilz et al. | |
| 7,681,365 | B2 | 3/2010 | Klein | |
| 7,716,891 | B2 | 5/2010 | Radford | |
| 7,752,817 | B2 | 7/2010 | Pilz et al. | |
| 7,775,006 | B2 | 8/2010 | Giannos | |
| 7,776,170 | B2 | 8/2010 | Yu et al. | |
| 7,810,295 | B2 | 10/2010 | Thompson | |
| 7,814,718 | B2 | 10/2010 | Klein | |
| 7,827,738 | B2 | 11/2010 | Abrams et al. | |
| 7,866,108 | B2 | 1/2011 | Klein | |
| 7,950,198 | B2 | 5/2011 | Pilz et al. | |
| 8,056,293 | B2 | 11/2011 | Klein | |
| 8,061,099 | B2 | 11/2011 | Andrews | |
| 8,062,108 | B2 | 11/2011 | Carlson et al. | |
| 8,069,625 | B2 | 12/2011 | Harkins et al. | |
| 8,074,416 | B2 | 12/2011 | Andrews | |
| 8,087,205 | B2 | 1/2012 | Pilz et al. | |
| 8,100,164 | B2 | 1/2012 | Goodman et al. | |
| 8,132,376 | B2 | 3/2012 | Pilz et al. | |
| 8,136,314 | B2 | 3/2012 | Klein | |
| 8,151,526 | B2 | 4/2012 | Klein | |
| 8,181,404 | B2 | 5/2012 | Klein | |
| 8,225,581 | B2 | 7/2012 | Strickland et al. | |
| 8,281,552 | B2 | 10/2012 | Pilz et al. | |
| 8,322,094 | B2 | 12/2012 | Pilz et al. | |
| 8,353,139 | B2 | 1/2013 | Pilz | |
| 8,413,394 | B2 | 4/2013 | Pilz et al. | |
| 8,495,844 | B1 * | 7/2013 | Johnson, Sr. | E04F 19/061 52/238.1 |
| 8,499,512 | B2 | 8/2013 | Pilz et al. | |
| 8,555,566 | B2 | 10/2013 | Pilz et al. | |
| 8,578,672 | B2 | 11/2013 | Mattox et al. | |
| 8,590,231 | B2 | 11/2013 | Pilz | |
| 8,595,999 | B1 | 12/2013 | Pilz et al. | |
| 8,596,019 | B2 | 12/2013 | Aitken | |
| 8,607,519 | B2 | 12/2013 | Hilburn | |
| 8,640,415 | B2 | 2/2014 | Pilz et al. | |
| 8,646,235 | B2 | 2/2014 | Hilburn, Jr. | |
| 8,671,632 | B2 | 3/2014 | Pilz et al. | |
| 8,728,608 | B2 | 5/2014 | Maisch | |
| 8,793,947 | B2 | 8/2014 | Pilz et al. | |
| 8,938,922 | B2 * | 1/2015 | Pilz | E04B 1/948 52/232 |
| 8,973,319 | B2 | 3/2015 | Pilz et al. | |
| 9,045,899 | B2 * | 6/2015 | Pilz | E04B 2/7411 |
| 9,127,454 | B2 | 9/2015 | Pilz et al. | |
| 9,206,596 | B1 | 12/2015 | Robinson | |
| 9,290,932 | B2 * | 3/2016 | Pilz | E04B 2/7457 |
| 9,290,934 | B2 | 3/2016 | Pilz et al. | |
| 9,371,644 | B2 | 6/2016 | Pilz et al. | |
| 9,512,614 | B2 | 12/2016 | Klein et al. | |
| 9,551,148 | B2 | 1/2017 | Pilz | |
| 9,616,259 | B2 | 4/2017 | Pilz et al. | |
| 9,637,914 | B2 | 5/2017 | Pilz et al. | |
| 2002/0029535 | A1 | 3/2002 | Loper | |
| 2002/0160149 | A1 | 10/2002 | Garofalo | |
| 2002/0170249 | A1 | 11/2002 | Yulkowski | |
| 2003/0079425 | A1 | 5/2003 | Morgan et al. | |
| 2003/0089062 | A1 | 5/2003 | Morgan et al. | |
| 2003/0213211 | A1 | 11/2003 | Morgan et al. | |
| 2004/0010998 | A1 | 1/2004 | Turco | |
| 2004/0016191 | A1 | 1/2004 | Whitty | |
| 2004/0045234 | A1 | 3/2004 | Morgan et al. | |
| 2004/0139684 | A1 | 7/2004 | Menendez | |
| 2004/0211150 | A1 | 10/2004 | Bobenhausen | |
| 2005/0183361 | A1 * | 8/2005 | Frezza | E02D 27/00 52/293.3 |
| 2005/0246973 | A1 | 11/2005 | Jensen | |
| 2006/0032163 | A1 | 2/2006 | Korn | |
| 2006/0123723 | A1 | 6/2006 | Weir et al. | |
| 2007/0056245 | A1 | 3/2007 | Edmondson | |
| 2007/0068101 | A1 | 3/2007 | Weir et al. | |
| 2007/0130873 | A1 | 6/2007 | Fisher | |
| 2007/0193202 | A1 | 8/2007 | Rice | |
| 2007/0261343 | A1 | 11/2007 | Stahl, Sr. | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0250738 | A1 | 10/2008 | Howchin | |
| 2009/0178369 | A1 | 7/2009 | Pilz et al. | |
| 2011/0041415 | A1 | 2/2011 | Esposito | |
| 2011/0056163 | A1 | 3/2011 | Kure | |
| 2011/0067328 | A1 | 3/2011 | Naccarato et al. | |
| 2011/0099928 | A1 | 5/2011 | Klein et al. | |
| 2011/0146180 | A1 | 6/2011 | Klein | |
| 2011/0167742 | A1 | 7/2011 | Klein | |
| 2011/0185656 | A1 | 8/2011 | Klein | |
| 2011/0214371 | A1 | 9/2011 | Klein | |
| 2012/0023846 | A1 | 2/2012 | Mattox et al. | |
| 2012/0066989 | A1 | 3/2012 | Pilz et al. | |
| 2012/0247038 | A1 | 10/2012 | Black | |
| 2012/0266550 | A1 | 10/2012 | Naccarato et al. | |
| 2012/0297710 | A1 | 11/2012 | Klein | |
| 2013/0086859 | A1 * | 4/2013 | Pilz | E04B 1/948 52/232 |
| 2014/0219719 | A1 | 8/2014 | Hensley et al. | |
| 2015/0135631 | A1 | 5/2015 | Foerg | |
| 2015/0275510 | A1 | 10/2015 | Klein et al. | |
| 2015/0337530 | A1 | 11/2015 | Pilz | |
| 2016/0017599 | A1 | 1/2016 | Klein et al. | |
| 2016/0097197 | A1 | 4/2016 | Pilz | |
| 2016/0123003 | A1 | 5/2016 | Pilz | |
| 2016/0130802 | A1 | 5/2016 | Pilz | |
| 2016/0201319 | A1 | 7/2016 | Pilz | |
| 2016/0265219 | A1 | 9/2016 | Pilz | |
| 2016/0296775 | A1 | 10/2016 | Pilz | |
| 2017/0016227 | A1 | 1/2017 | Klein | |
| 2017/0044762 | A1 | 2/2017 | Pilz | |
| 2017/0130445 | A1 | 5/2017 | Pilz | |

FOREIGN PATENT DOCUMENTS

| | | |
|---|---|---|
| CA | 2736834 | 12/2015 |
| EP | 0 346 126 | 12/1989 |
| GB | 2 159 051 | 11/1985 |
| GB | 2 411 212 | 8/2005 |
| JP | 06-146433 | 5/1994 |
| JP | 06-220934 | 8/1994 |
| WO | WO 03/038206 | 5/2003 |
| WO | WO 2007/103331 | 9/2007 |
| WO | WO 2009/026464 | 2/2009 |

OTHER PUBLICATIONS

U.S. Appl. No. 15/074,424, filed Mar. 18, 2016, Pilz et al.
U.S. Appl. No. 15/186,233, filed Jun. 17, 2016, Pilz et al.
BlazeFrame 2009 catalog of products, available at least as of Mar. 4, 2010 from www.blazeframe.com, in 20 pages.
Canadian First Office Action for Application No. 2,697,295, dated Sep. 21, 2011, in 4 pages.
Canadian Second Office Action for Application No. 2,697,295, dated May 23, 2012, in 4 pages.
Canadian Office Action for Application No. 2,827,183, dated Mar. 27, 2015 in 4 pages.
Canadian Office Action for Application No. 2,827,183, dated Mar. 7, 2016 in 4 pages.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. CD-FTSC11 Jul. 2011. 1 page.
DoubleTrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.

(56) References Cited

OTHER PUBLICATIONS

Information Disclosure Statement letter; U.S. Appl. No. 12/196,115, dated Aug. 4, 2011.
International Search Report for Application No. PCT/US2008/073920, dated Apr. 9, 2009.
James A. Klein's Answer, Affirmative Defenses and Counterclaims to Third Amended Complaint; U.S. District Court, Central District of California; Case No. 2:12-CV-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
U.S. Appl. No. 15/462,671, filed Mar. 17, 2017, Pilz.
U.S. Appl. No. 15/469,370, filed Mar. 24, 2017, Pilz et al.
U.S. Appl. No. 15/481,272, filed Apr. 6, 2017, Pilz.
"Intumescent Expansion Joint Seals", Astroflame; http://www.astroflame.com/intumescent_expansion_joint_seals; Jul. 2011; 4 pages.
"System No. HW-D-0607", May 6, 2010, Metacaulk, www.rectorseal.com, www.metacault.com; 2008 Underwriters Laboratories Inc.; 2 pages.

* cited by examiner

FIG. 5
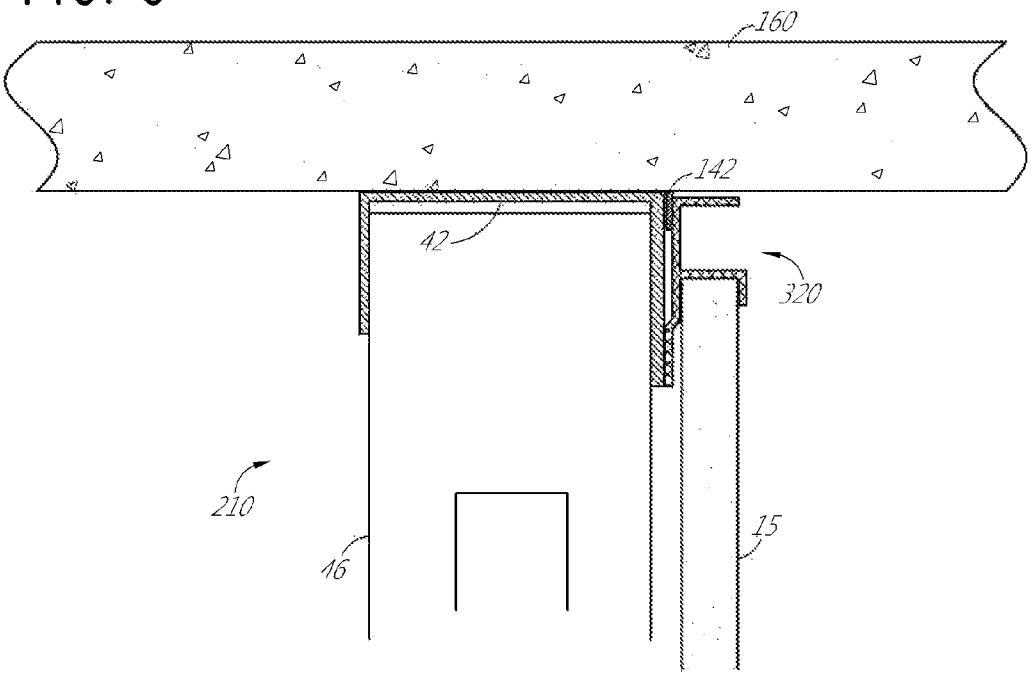
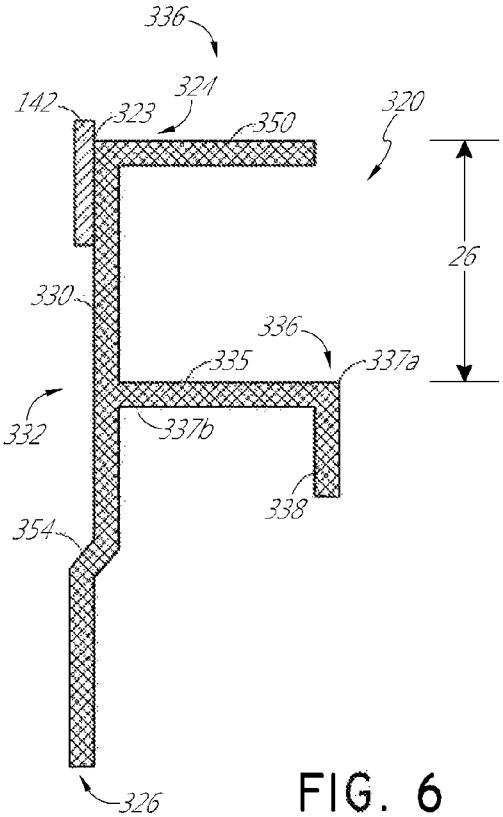
FIG. 6

FIRE BLOCKING REVEAL

INCORPORATION BY REFERENCE TO ANY PRIORITY APPLICATIONS

Any and all applications for which a foreign or domestic priority claim is identified in the Application Data Sheet as filed with the present application are hereby incorporated by reference herein.

BACKGROUND OF THE INVENTION

Field of the Invention

The present invention generally relates to fire-rated building structures. In particular, the present invention relates to fire-rated joint systems, wall assemblies, and other building structures that incorporate fire block angles, straps, reveals, and related assemblies.

Description of the Related Art

Fire-rated construction components and assemblies are commonly used in the construction industry. These components and assemblies are aimed at preventing fire, heat, and smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat or smoke for at least some period of time. Intumescent materials work well for this purpose, because they swell and char when exposed to flames helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. Another wall joint with a high potential for allowing fire, heat or smoke to pass from one room to another is the joint between the bottom of a wall and the floor, which can be referred to as a bottom-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages that are described herein.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and at least one flange extending from the web. Typically, the header track includes a pair of flanges, which extend in the same direction from opposing edges of the web. The header track can be slotted header track, which includes a plurality of slots spaced along the length of the track and extending in a vertical direction.

When the wall studs are placed into the slotted track, each of the plurality of slots accommodates a fastener used to connect the wall stud to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, as described above. Similarly, bottom tracks generally have a web and at least one flange extending from the web. Typically, the bottom track includes a pair of flanges, which extend in the same direction from opposing edges of the web. The bottom track typically is not slotted and the studs are fixed relative to the bottom track.

Recently, improved methods of providing a fire-rated head-of-wall joint have been developed. One example of a fire-rated wall construction component is a head-of-wall fire block device sold by the Assignee of the present application under the trademark FireStik®. The FireStik® fire block product incorporates a metal profile with a layer of intumescent material on its inner surface. The metal profile of the FireStik® fire block product is independently and rigidly attached to a structure, such as the bottom of a floor or ceiling, at a position adjacent to the gap between the wallboard (e.g., drywall) and the ceiling on the opposite side (i.e., outside) of the wallboard relative to the studs and header track. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present.

When temperatures rise, the intumescent material on the FireStik® fire block product expands rapidly and chars. This expansion creates a barrier which fills the head-of-wall gap and inhibits or at least substantially prevents fire, heat and smoke from moving through the head-of-wall joint and entering an adjacent room for at least some period of time.

Still another example of an improved construction component for creating a fire-rated head-of-wall joint is a header track with integrated intumescent material strips sold by the Assignee of the present application under the trademark FAS Track®. In contrast to the FireStik® fire block product, the FAS Track® header track product incorporates the intumescent material directly on the header track so that the fire block material is installed during the framing process. Both the FireStik® and the FAS Track® fire block products are typically installed by the framing crew. The integration of the intumescent material into the FAS Track® header track product eliminates the need to install an additional fire block product after the wall board has been installed, which is typically done by a different crew than the framing crew.

SUMMARY OF THE INVENTION

Although the FireStik® and the FAS Track® products represent an improvement over the conventional method of stuffing mineral wool material into the head-of-wall joint and applying the elastomeric spray material over the mineral wool, there still exists room for improved products and methods for efficiently and cost-effectively creating fire-rated wall joints. Certain embodiments of the present invention involve a fire-rated wall joint product, such as a reveal piece, that incorporates a fire-resistant or intumescent material on at least one surface of the reveal piece. The reveal piece can be installed prior to the installation of the wall board and, preferably, during the framing process. The reveal piece may be installed directly against the studs to allow a wood or aluminum base trim piece to be recessed such that the trim piece is flush with the drywall. In some embodiments, the reveal piece includes a wallboard support to hold the wallboard or drywall in place.

Drywall reveals have been utilized in wall assembly design for decades. Whether at the base of wall, head of wall or somewhere in the middle of the wall, drywall reveals are commonly used as an architectural feature. When drywall reveals are utilized on a fire-rated wall, the wall assembly has a much higher cost. On current fire-rated walls, the drywall is installed without breaks from floor to ceiling. This requires a full layer of drywall to be installed first and then the reveals are installed followed by a second layer of drywall with the drywall breaking on both sides of the reveal. For this reason, the contractor basically needs to put two layers of drywall to maintain fire rating that would typically only require one layer for the fire rating.

Certain embodiments of the present invention involve a fire-rated reveal that combines steel (or another suitable reveal material) and fire-retardant or intumescent material. The steel profile is bent in a profile that, in some arrangements, allows a termination point for the drywall, a portion for an exposed reveal, and a fire block that will provide a fire rating without requiring an extra layer of drywall.

In some configurations, the fire-blocking feature is achieved by placing fire-retardant material or intumescent tape between two layers of steel of the reveal. When fire is introduced, the fire retardant material will expand between the two layers of steel, creating a separation between the two layers and thereby insulating the steel profile area of the wall that does not have drywall. In some embodiments, fire-retardant material may be placed on an exterior surface of the reveal piece such that at least a portion of the fire-retardant material extends beyond the corner of the reveal piece. The fire-retardant material is then pressed against the ceiling or floor, depending on the installation location of the reveal piece, to provide fire-blocking at a head- or bottom-of-wall joint. In some configurations, fire retardant material may not be necessary as the two layers of material may be sufficient.

In one aspect, a fire-rated assembly for a linear wall gap includes a track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section; a strap piece comprising having a first free end and a second free end, a first bend and a second bend defined between the first free and the second free end, the first bend and the second bend defining a first vertical leg portion and a second vertical leg portion forming a gap therebetween, the first and second vertical leg portions formed from a single piece of material; a heat-expandable intumescent strip attached to the strap piece and extending lengthwise along an interior-facing surface of the strap piece, the intumescent strip adjacent the second bend; wherein, in use, the strap is positioned adjacent to one of the first flange and the second flange of the track structure such that the intumescent strip is between the strap piece and one of the first flange and the second flange of the track.

In some aspects, the strap further comprises a hem defined between the first bend and the first free end, the hem substantially parallel to the first and second vertical leg portions. In some aspects, the first and second vertical leg portions and the hem are each planar and substantially parallel to each other. In some aspects, the first and second vertical leg portions and the hem are formed from a single piece of material. In some aspects, the strap further comprises a second intumescent material applied to one of the first vertical leg portion and the second vertical leg portion such that the intumescent material is within the gap between the first vertical leg portion and the second vertical leg portion. In some aspects, the strap further comprises a wallboard support defined between the first bend and the first free end, the wallboard support having a substantially J-shaped profile and extending outwards from the first and second vertical leg portions.

In another aspect, a fire-rated wall joint product includes a strap piece comprising having a first free end and a second free end, a first bend and a second bend defined between the first free and the second free end, the first bend and the second bend defining a first vertical leg portion and a second vertical leg portion forming a gap therebetween, the first and second vertical leg portions being formed from a single piece of material; and a heat-expandable intumescent strip attached to the strap piece and extending lengthwise along an interior-facing surface of the strap piece, the intumescent strip adjacent the second bend.

In some aspects, the joint product further includes a second intumescent material applied to one of the first vertical leg portion and the second vertical leg portion such that the intumescent material is between the first vertical leg portion and the second vertical leg portion. In some aspects, the strap further comprises a hem defined between the first bend and the first free end, the hem substantially parallel to the first and second vertical leg portions. In some aspects, the first and second vertical leg portions and the hem are each planar and substantially parallel to each other. In some aspects, the first and second vertical leg portions and the hem are formed from a single piece of material. In some aspects, the strap further includes a second intumescent material applied to one of the first vertical leg portion and the second vertical leg portion such that the intumescent material is between the first vertical leg portion and the second vertical leg portion. In some aspects, the strap further includes a wallboard support defined between the first bend and the first free end, the wallboard support having a substantially J-shaped profile and extending outwards from the first and second vertical leg portions. In some aspects, the strap further includes a kickout portion such that the kickout portion forms an approximately 100 degree angle with the first and second vertical leg portions.

In yet another aspect, a fire-rated wall joint product includes an elongated piece comprising a strap having a first bend, a second bend, a free edge and a hem, the strap and the hem being formed from a single piece of material; and an intumescent material strip applied to an exterior surface of the strap and extending beyond the second bend of the strap, wherein a length of the intumescent material strip is equal to or less than about one-half a height of the strap.

In some aspects, the strap has a two-ply section having a first layer and a second layer such that the free edge of the strap is adjacent the hem, the two-ply section forming a gap between the first layer and the second layer. In some aspects, an intumescent material is applied within the gap.

BRIEF DESCRIPTION OF THE DRAWINGS

Certain features, aspects and advantages of the various devices, systems and methods presented herein are described with reference to drawings of certain embodiments, which are intended to illustrate, but not to limit, such devices, systems, and methods. It is to be understood that the drawings are for the purpose of illustrating concepts of the embodiments discussed herein and may not be to scale. For example, certain gaps or spaces between components illustrated herein may be exaggerated to assist in the understanding of the embodiments. Dimensions, if provided in the specification, are merely for the purpose of example in the context of the specific arrangements shown and are not intended to limit the disclosure. The drawings contain ten (10) figures.

FIG. 5 is a cross-sectional view of a head-of-wall assembly incorporating another embodiment of a fire-rated reveal.

FIG. 6 is a side profile view of the fire-rated reveal shown in the wall assembly of FIG. 5.

DETAILED DESCRIPTION OF THE PREFERRED EMBODIMENTS

Several preferred embodiments of the fire-rated reveal pieces and fire-rated reveal systems are described herein, typically in the context of a wall assembly and, in particular, a bottom-of-wall assembly. However, the fire-rated reveal pieces and fire-rated reveal systems can also be used in other applications, such as at the head or sides of a wall or a joint in an intermediate location of a wall. The fire-rated reveal pieces and fire-rated reveal systems can also be used in non-wall applications. In view of the bottom-of-wall assembly being but one of the multiple applications for the fire-rated reveal pieces and fire-rated reveal systems, the use of relative or directional terminology, or other such descriptions, is for convenience in describing the particular embodiments, arrangements or orientations shown. Therefore, such terms are not intended to be limiting, unless specifically designated as such.

Figure 1:
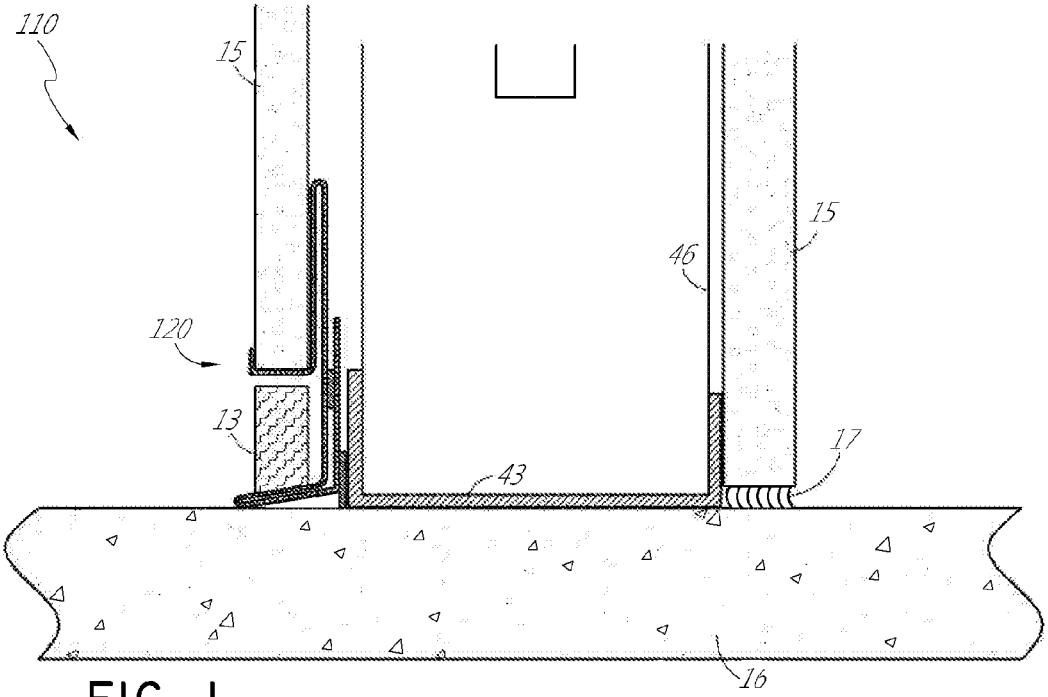
FIG. 1 is a cross-sectional view of a bottom-of-wall assembly incorporating a fire-rated reveal according to an embodiment.
Figure 2:
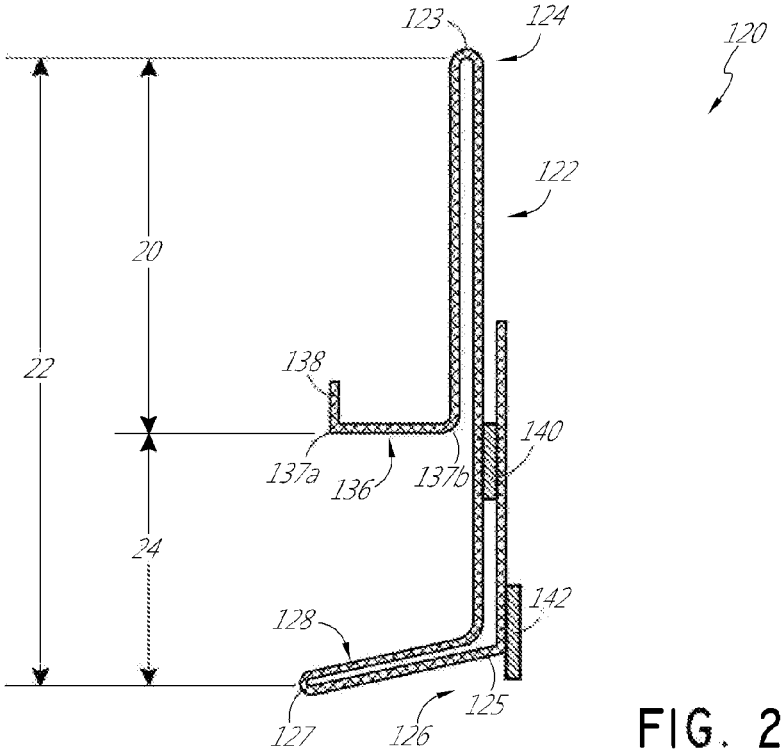
FIG. 2 is a side profile view of the fire-rated reveal shown in the wall assembly of FIG. 1.

FIGS. 1 and 2 illustrate an embodiment of a fire-rated reveal 120, which is also referred to herein simply as reveal 120, incorporated into a bottom-of-wall assembly 110 (FIG. 1) and alone in closer detail (FIG. 2). The reveal 120 is preferably formed from a light gauge steel material by any suitable process, such as roll forming, for example. Preferably, the reveal 120 is an elongated member having a consistent or substantially consistent cross-sectional shape throughout its length. One or more preferred embodiments of the reveal 120 are generally or substantially J-shaped in cross-section. In one embodiment, the reveal 120 may be between about 5 feet and 25 feet in length. The reveal 120 can also be between about 10 and 20 feet in length. Preferably, the reveal 120 is about 10-12 feet in length to facilitate shipping and storage. Desirably, the reveal 120 is sufficiently long to allow installation along a wall with a relatively small number of pieces. However, the length of the reveal 120 should be short enough that shipping and material handling is relatively convenient. Accordingly, the above-recited lengths are presently preferred. However, other lengths may also be used in other situations.

Preferably, as shown in FIG. 2, the reveal 120 includes a vertical reveal leg 122, a kickout portion 128, and a J-shaped wallboard support portion 136. The illustrated vertical leg 122, kickout portion 128, and J-shaped wallboard support portion 136 are preferably unitarily formed. That is, the vertical leg 122, the kickout portion 128, and the J-shaped wallboard support portion 136 are constructed from a single piece of material. As described above, typically, the single piece of material is a flat piece of light gauge steel, which is then deformed into the shape of the reveal 120, such as through a roll-forming, bending (such as on a press brake) or other suitable process. Preferably, both the vertical leg 122 and the kickout portion 128 are substantially planar and define an angle therebetween of about 110 degrees or, in some arrangements, less than or more than 110 degrees. For example, the leg 122 and kickout 128 may define an angle of between about 80 degrees and about 120 degrees, between about 85 degrees and 115 degrees or about 110 degrees. In other embodiments, as discussed below, the kickout portion 128 and the wallboard support portion 136 are optional and may be omitted.

With continued reference to FIG. 2, the reveal 120 is formed from metal sheet material 130 that is bent to form a substantially 180 degree bend 123 at a first end 124 of the vertical leg 122 and bent to form an approximately 90-100 degree angle at a second end 126 of the vertical leg 122. The wallboard support 136 is formed by bending one free end of the metal sheet 130 away from the vertical leg portion 122. The wallboard support 136 includes two bends 137*a*, 137*b* forming a substantially planar section between the two bends 137*a*, 137*b*. A free end of the metal sheet 130 extends upward, substantially parallel to the vertical leg 122, to provide a lip 138 of the wallboard support 136 to hold the wallboard 15 in place, as shown in FIG. 1.

The kickout portion 128 is formed from a second end 126 of the metal sheet 130, by bending the metal sheet 130 to form a corner 125. The portion of the vertical leg 122 adjacent to the corner 125 and vertically lower than the J-shaped wallboard support 136 is also called the reveal portion of the vertical reveal leg 122. The kickout portion 128 extends outward, that is, away from the bottom track 43, of the wall assembly 110, in the same direction as the wallboard support portion 136. While the wallboard support portion 136 is generally a single ply or single layer of material, the kickout portion 128, is formed from a two-ply, or double layer of material. The material 130 may be bent approximately 180 degrees to form bend 127 at the outward end of the kickout portion 128. As shown in FIG. 2, the kickout portion 128 preferably forms an angle greater than 90 degrees with the vertical leg 122, such that the kickout portion 128 extends outward and downward relative to the vertical leg 122.

The material 130 of the reveal 120 is bent, at corner 125, to allow the material to extend upwards, forming part of the two-ply section of the vertical leg 122. In some embodiments, including the embodiment shown in FIG. 2, a free end of the material 130 extends vertically beyond the substantially planar section 135 of the wallboard support 136 such that the vertical leg 122 has a small three-ply or triple layer section.

With further reference to FIG. 2, in some embodiments a total width or height 22 of the reveal 120 is approximately 6 inches. In other embodiments, the total width or height 22 of the reveal 120 may be between approximately 2 inches and approximately 8 inches, between approximately 3 inches and approximately 7 inches, or approximately 6 inches. In some embodiments, the substantially planar section 135 of the wallboard support member 136 has a height or width 20 of approximately 2 inches vertically lower than the bend 123 of the reveal 120. In other embodiments, the height or width 20 may be between approximately 1.5 inches and approximately 3 inches vertically lower than the bend 123 or between approximately 2 inches and approximately 3 inches vertically lower than the bend 123. In some embodiments, a height or width 24 of the reveal section of the reveal 120 may be approximately 4 inches. In other embodiments, the height or width 24 may be between approximately 3 and 6 inches or between approximately 2 and 5 inches. Preferably, the wallboard 15 overlaps the reveal 120 by at least 2 inches or an amount suitable to maintain a seal between the wallboard 15 and the reveal 120.

Since the reveal 120 is preferably made from a single sheet of material, the bending process to form the reveal 120 results in several two-ply, or double layer, sections. As shown in FIG. 2, the vertical reveal leg 122 has at least a double layer along the entire length of the leg 122, with at least a portion of the leg 122 having a three-ply section, due to the overlap between the wallboard support portion and the vertical leg 122. One of the benefits of a two-ply construction is the additional fire protection provided by the added layer of material as well as any insulation gap therebetween.

For further fire protection, intumescent material may be placed on an exterior surface of the reveal 120 or between layers of material forming the two- or three-ply sections of the vertical leg 122 of the reveal 120. For example, as shown in FIG. 2, in one embodiment, intumescent material such as a piece of intumescent tape or intumescent strip 140 may be placed between two of the layers of the vertical leg 122. The intumescent material may be any kind of fire blocking material, such as intumescent tape, strips, or paint. The intumescent material 140 may be applied to one section of the material 130 prior to bending to form the shape of the reveal 120 shown in FIG. 2, or may be applied after the reveal 120 has been formed. In some embodiments, the intumescent material 140 is placed vertically lower than the substantially planar section 135 of the wallboard support member 136. Another piece of intumescent material 142 may be placed on an exterior surface of the vertical leg 122 facing towards the track, such as bottom track 43, shown in FIG. 1. In other embodiments, intumescent material 140 may be placed at any point along the height or width 22 of the reveal 120 between two of the layers of steel material 130. In some embodiments, intumescent material 142 may be applied to an exterior surface of the reveal 120 that faces inward toward the bottom track, as shown in FIG. 1. Preferably, the intumescent material 142 extends below the corner 125 such that it can seal against an irregular floor surface when unexpanded and, when exposed to heat, the intumescent material can expand and form a fire block.

Preferably, as described above, the intumescent tape or strips 140, 142 are constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands to many times (e.g., up to 35 times or more) its original size when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the bottom-of-wall joint, head-of-wall joint or other wall joint. Thus, intumescent materials are preferred for many applications. However, other fire retardant materials can also be used. Therefore, the term intumescent strip is used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated. The intumescent strips 140, 142 can have any suitable thickness that provides a sufficient volume of intumescent material to create an effective fire block for the particular application, while having small enough dimensions to be accommodated in a wall assembly. That is, preferably, the intumescent material strips 140, 142 do not cause unsightly protrusions or humps in the wall from excessive build-up of material. In one arrangement, the thickness of the intumescent strips 140, 142 is between about 1/16 (0.0625) inches and 1/8 (0.125) inches, or between about 0.065 inches and 0.090 inches. One preferred thickness is about 0.075 inches.

With reference to FIG. 1, a bottom-of-wall assembly 110 is illustrated, incorporating the reveal 120 shown in FIG. 2. The wall assembly 110 includes a concrete floor 16 to which is attached a bottom track 43. The reveal 120 is installed along with the bottom track 43 or after the bottom track 43. The bottom track 43 is configured to receive a plurality of metal wall studs, such as stud 46. Wallboard, such as drywall 15, is placed within the wallboard support portion 136 of the reveal 120 on one side of the wall. The opposite side of the wall does not incorporate a reveal 120 and the drywall 15 is fastened directly to the bottom track 43. However, in other embodiments, the bottom-of-wall assembly 110 may include two reveals 120 with one reveal 120 on either side of the wall assembly 110. A trim piece 13 may be attached to the reveal 120 such that the trim piece 13 is approximately flush with the wallboard 15, as illustrated in FIG. 1.

Figure 3:
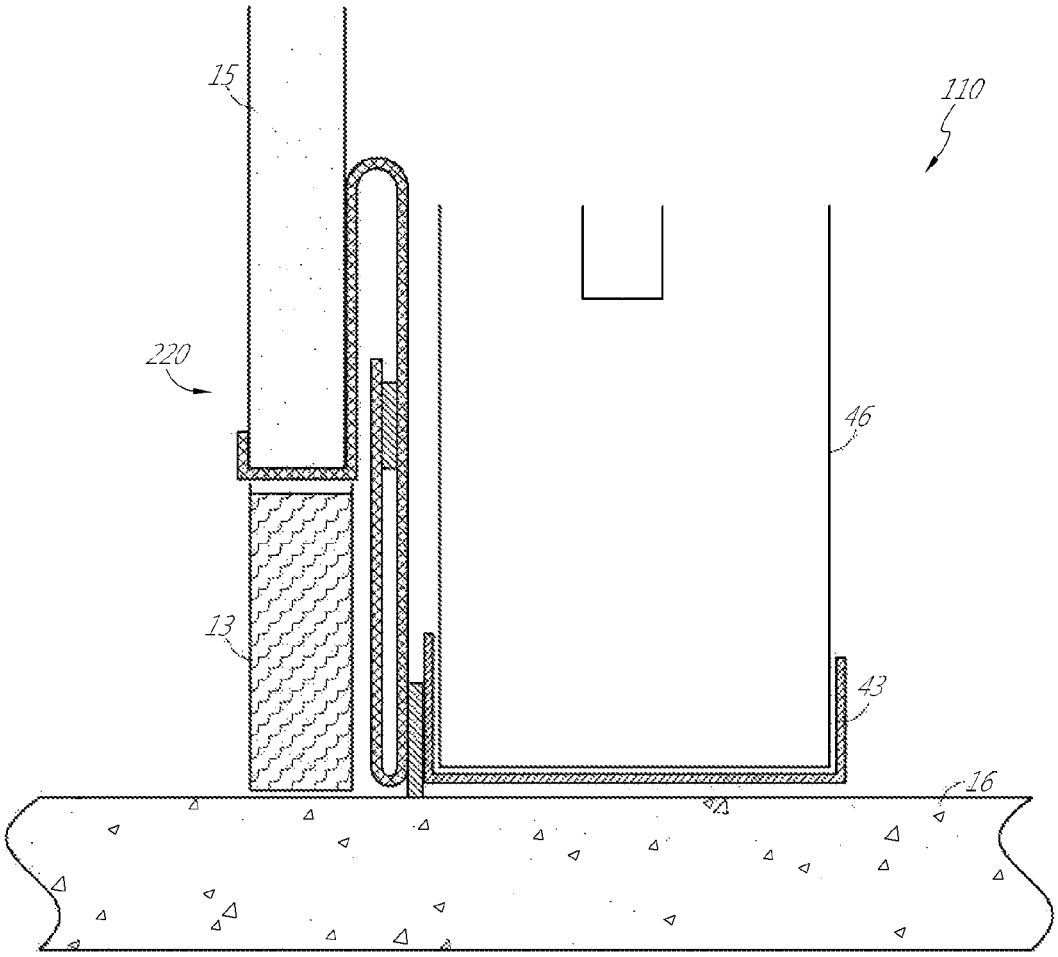
FIG. 3 is a cross-sectional view of a bottom-of-wall assembly incorporating another embodiment of a fire-rated reveal
Figure 4:
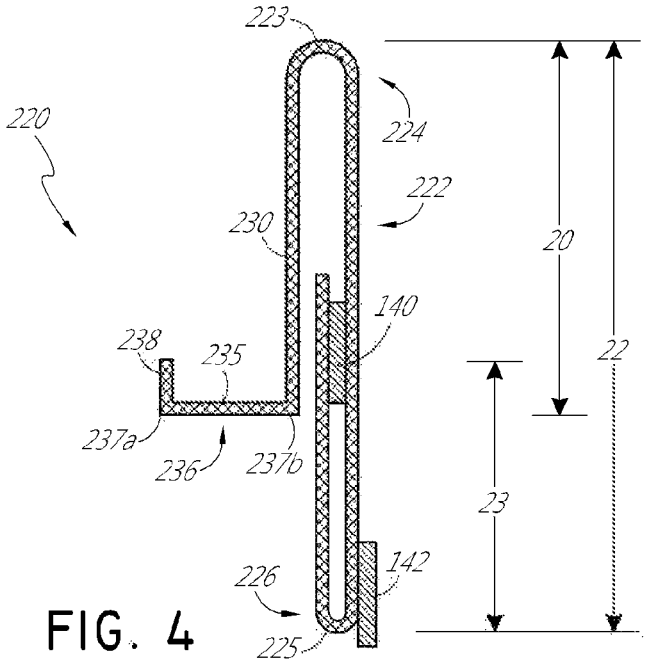
FIG. 4 is a side profile view of the fire-rated reveal shown in the wall assembly of FIG. 3.

FIGS. 3 and 4 illustrate another embodiment of a fire-rated reveal 220, which is also referred to herein simply as a reveal 220, incorporated into a bottom-of-wall assembly (FIG. 3) and alone in closer detail (FIG. 4). The reveal 220 is preferably formed from a light gauge steel material by any suitable process, such as roll forming, for example. Preferably, the reveal 220 is an elongated member having a consistent or substantially consistent cross-sectional shape throughout its length. One or more preferred embodiments of the reveal 220 are generally or substantially J-shaped in cross-section. In one embodiment, the reveal 220 may be between about 5 feet and 25 feet in length. The reveal 220 can also be between about 10 and 20 feet in length. Preferably, the reveal 220 is about 10-12 feet in length to facilitate shipping and storage.

Similar to the reveal 120 shown in FIG. 2, the reveal 220 includes a vertical reveal leg 222 and a J-shaped wallboard support portion 236. The illustrated vertical leg 222 and J-shaped wallboard support portion 236 are preferably unitarily formed. That is, the vertical leg 222 and the J-shaped wallboard support portion 236 are constructed from a single piece of material. As described above, typically, the single piece of material is a flat piece of light gauge steel, which is then deformed into the shape of the reveal 220, such as through a roll-forming, bending (such as on a press brake) or other suitable process. Preferably, the vertical leg 222 is substantially planar.

With continued reference to FIG. 4, the reveal 220 is formed from metal sheet material 230 that is bent to form a substantially 180 degree bend 223 at a first end 224 of the vertical leg 222 and bent to form an approximately 180 degree bend 225 at a second end 226 of the vertical leg 222. The wallboard support 236 is formed by bending a free end of the metal sheet 230 away from the vertical leg portion 222. The wallboard support 236 includes two bends 237*a*, 237*b* forming a substantially planar section 235 between the two bends 237*a*, 237*b*. A free end of the metal sheet 230 extends upward, substantially parallel to the vertical leg 222, to provide a lip 238 of the wallboard support 236 to hold the wallboard 15 in place, as shown in FIG. 3. In some embodiments, a height or width of the lip 238 is approximately 0.5 inch.

The portion of the vertical leg 222 adjacent to the bend 225 is also called the reveal portion of the vertical reveal leg 222, and is preferably a two-ply or two layer section. The wallboard support portion 236 is generally a single ply or single layer of material.

During manufacture, the material 230 is bent, forming bend 225, to allow the material to extend upwards and form part of the two-ply section of the vertical leg 222. In some embodiments, including the embodiment shown in FIG. 4, a free end of the material 230 extends vertically beyond the substantially planar section 235 of the wallboard support 236 such that the vertical leg 222 has a small three-ply or triple layer section.

The reveal 220 preferably has dimensions similar to those discussed above with respect to reveal 120. With further reference to FIG. 4, in some embodiments a total width or height 20 of the reveal 220 is approximately 6 inches. In other embodiments, the total width or height of the reveal 220 may be between approximately 2 inches and approximately 8 inches or between approximately 3 inches and approximately 7 inches. In some embodiments, the substantially planar section 235 of the wallboard support member 236 may be approximately 3 inches vertically lower than the bend 223 of the reveal 220, as shown by height or width 20. In other embodiments, the substantially planar section 235 of the wallboard support member 236 may be between approximately 2 inches and approximately 4 inches vertically lower than the bend 223 or between approximately 2.5 inches and approximately 3.5 inches vertically lower than the bend 223, as illustrated by height or width 20. In some embodiments, a height or width 23 of the reveal section of the reveal 220 may be approximately 4 inches. In other embodiments, a height or width 23 of the reveal section of the reveal 220 may be between 3 and 5.

Since the reveal 220 is preferably made from a single sheet of material, the bending process to form the reveal 220 results in several two-ply, or double layer, sections. As shown in FIG. 4, the vertical reveal leg 222 has at least a double layer along the entire length of the leg 222, with at least a portion of the leg 222 having a three-ply section, due to the overlap between part of the wallboard support portion, the vertical leg 222, and a free end of the material 230. One of the benefits of a two-ply construction is the additional fire protection provided by the added layer of material, preferably steel, and any insulation gap therebetween.

For further fire protection, intumescent material may be placed on an exterior surface of the reveal 220 or between layers of material forming the two- or three-ply sections of the vertical leg 222 of the reveal 220. For example, as shown in FIG. 4, in one embodiment, intumescent material such as a piece of intumescent tape or intumescent strip 140 may be placed between two of the layers of the vertical leg 222. The intumescent material may be any kind of fire blocking material, such as intumescent tape, strips, or paint. The intumescent material 140 may be applied to one section of the material 230 prior to bending to form the shape of the reveal 220 shown in FIG. 4, or may be applied after the reveal 220 has been formed. In some embodiments, the intumescent material 140 is placed such that a vertically lower end of the intumescent material 140 is substantially level with the substantially planar section 235 of the wallboard support member 236. In other embodiments, the intumescent material 140 may be placed anywhere between the two layers forming the vertical leg 222. Another piece of intumescent material 142 may be placed on an exterior surface of the vertical leg 222 facing towards the track, such as bottom track 43, shown in FIG. 3. In some embodiments, the intumescent material 142 extends below the bend 225 such that when exposed to heat, the intumescent material can expand and form a fire block.

With reference to FIG. 3, another embodiment of a bottom-of-wall assembly 110 is illustrated, incorporating the reveal 220 shown in FIG. 2. FIG. 3 illustrates a bottom-of-wall assembly similar to that shown in and described with reference to FIG. 1. Accordingly, the same reference numbers are used to describe the same or corresponding components. The wall assembly 110 includes a bottom track 43 attached to a concrete floor 16. The reveal 220 is installed along with the bottom track 43 or after the bottom track 43. The bottom track 43 is configured to receive a plurality of metal wall studs, such as stud 46. Wallboard, such as drywall 15, is placed within the wallboard support portion 236 of the reveal 220 on one side of the wall. As illustrated in FIG. 3, the opposite side of the wall does not incorporate a reveal 220 and the drywall 15 is fastened directly to the bottom track 43. However, in other embodiments, the bottom-of-wall assembly 110 may include two reveals 220 with one reveal 220 on either side of the wall assembly 110.

FIGS. 5 and 6 illustrate another embodiment of a combination fire-rated angle piece and reveal 320, which is also referred to herein simply as reveal 320, incorporated into a head-of-wall assembly (FIG. 5) and alone in closer detail (FIG. 6). The fire-rated angle piece and reveal 320 is preferably used in a head-of-wall assembly, separate from the header track, to provide fire protection that can be installed along with the installation of the header track or installed after the installation of the header track to avoid the need to have the framers return after installation of the wall board. Similar to the reveals 120, 220, the reveal 320 is preferably formed from a light gauge steel material by any suitable process, such as roll forming, for example. Preferably, the reveal 320 is an elongated member having a consistent or substantially consistent cross-sectional shape throughout its length. One or more preferred embodiments of the reveal 320 are generally or substantially inverted J-shaped in cross-section. In one embodiment, the reveal 320 may be between about 5 feet and 25 feet in length. The reveal 320 can also be between about 10 and 20 feet in length. Preferably, the reveal 320 is about 10-12 feet in length to facilitate shipping and storage. Additionally, the reveal 320, as well as reveals 120, 220, can be stacked and shipped without damaging the intumescent material more easily that than a header or bottom track that incorporates the intumescent material.

Similar to the reveals 120, 220 discussed above, the reveal 320 includes a vertical reveal leg 322 and an inverted J-shaped wallboard support portion 336. The illustrated vertical leg 322 and inverted J-shaped wallboard support portion 336 are preferably unitarily formed. That is, the vertical leg 322 and the inverted J-shaped wallboard support portion 336 are constructed from a single piece of material. As described above, typically, the single piece of material is a flat piece of light gauge steel, which is then deformed into the shape of the reveal 320, such as through a roll-forming, bending (such as on a press brake) or other suitable process. Preferably, the vertical leg 322 is substantially planar.

With continued reference to FIG. 6, the reveal 320 is formed from metal sheet material 330 that is bent in a first direction to form a substantially 90 degree corner 323 at a first end 324 of the vertical leg 322. Preferably, as shown in FIG. 6, the reveal 320 is a single layer, or single ply piece. The horizontal leg 350 extends away from the corner 323 to form a substantially planar leg. Along with the vertical leg 322, the horizontal leg 350 forms an angle similar to the angles described in U.S. Pat. No. 8,595,999, which is incorporated herein in its entirety. The wallboard support 336 is formed by bending one free end of the metal sheet 330 away from the vertical leg portion 322. Similar to the reveals 120, 220 discussed above, the wallboard support 336 includes two bends forming a substantially planar section 335 between the two bends 337*a*, 337*b*. A free end of the metal sheet 330 extends vertically downward, substantially parallel to the vertical leg 322, to provide a lip 338 of the wallboard support 336 to hold the wallboard 15 in place, as shown in FIG. 5. Other embodiments could have the same profile shape as shown in FIG. 6 formed by different bends of the material piece and may have single layer portions where two layers are shown in FIG. 6 and vice versa.

With reference to FIG. 5, an embodiment of a head-of-wall assembly 210 is illustrated, incorporating the reveal 320 shown in FIG. 6. The head-of-wall assembly 210 incorporates some of the same components as shown in the bottom-of-wall assemblies 110 illustrated in FIGS. 1 and 3. Accordingly, the same reference numbers are used to describe the same or corresponding components. The wall assembly 210 includes a header track 42 attached to a concrete ceiling member 160. The reveal 320 is installed along with the header track 42 or after the header track 42. The header track 42 is configured to receive a plurality of metal wall studs, such as stud 46. Wallboard, such as drywall 15 is placed within the wallboard support portion 336 of the reveal 320 on one side of the wall. As illustrated in FIG. 5, the opposite side of the wall does not incorporate a reveal 320. However, in other embodiments, the head-of-wall assembly 210 may include two reveals 320 with one reveal 320 on either side of the wall assembly 210.

In some embodiments, as shown in FIG. 6, the vertical leg 322 includes a kickout section 354. The kickout section 354 includes a bend in the material 330 to form an attachment flange 340. The attachment flange 340 preferably presses against the header track 42, as shown in FIG. 5. A mechanical fastener 48, such as a framing screw, can be used to attach the reveal 320 to the header track 42 between studs 46 and, in some cases, to the metal stud 46.

The reveal 320 can have similar dimensions as those discussed above with respect to reveals 120 and 220. With further reference to FIG. 6, in some embodiments a total width or height of the reveal 320 is approximately 6 inches. In other embodiments, the total width or height of the reveal 320 may be between approximately 2 inches and approximately 8 inches or between approximately 3 inches and approximately 7 inches. The vertical portion of the vertical leg 322 between the corner 323 and the inverted J-shaped wallboard support 336 is the reveal portion. The reveal portion may have a height or width 26 that may vary depending on the type of application. In some embodiments, the height or width 26 is approximately 3 inches. In other embodiments, the height or width 26 is between approximately 2 inches and approximately 4 inches or between approximately 2.5 inches and approximately 3.5 inches.

For further fire protection, intumescent material may be placed on an exterior surface of the reveal 320. For example, as shown in FIG. 6, intumescent material 142, such as an intumescent strip or intumescent tape, may be placed on an exterior surface of the vertical leg 322 facing towards the track, such as header track 42, shown in FIG. 5. Preferably, the intumescent material 142 extends above the corner 323 such that, when exposed to heat, the intumescent material can expand and form a fire block.

In some embodiments, preferably the thickness of the fire-stopping or intumescent material 142 is such that the outermost edge of the intumescent material 142 aligns with the attachment flange 240. This alignment allows the intumescent material 142 to be pressed against the header track 42 to provide a fire-blocking barrier. While one embodiment of the reveal 320 is shown in FIG. 6, the reveal 320 can take the shape of any of the reveals 120, 220 discussed above.

Figure 7:
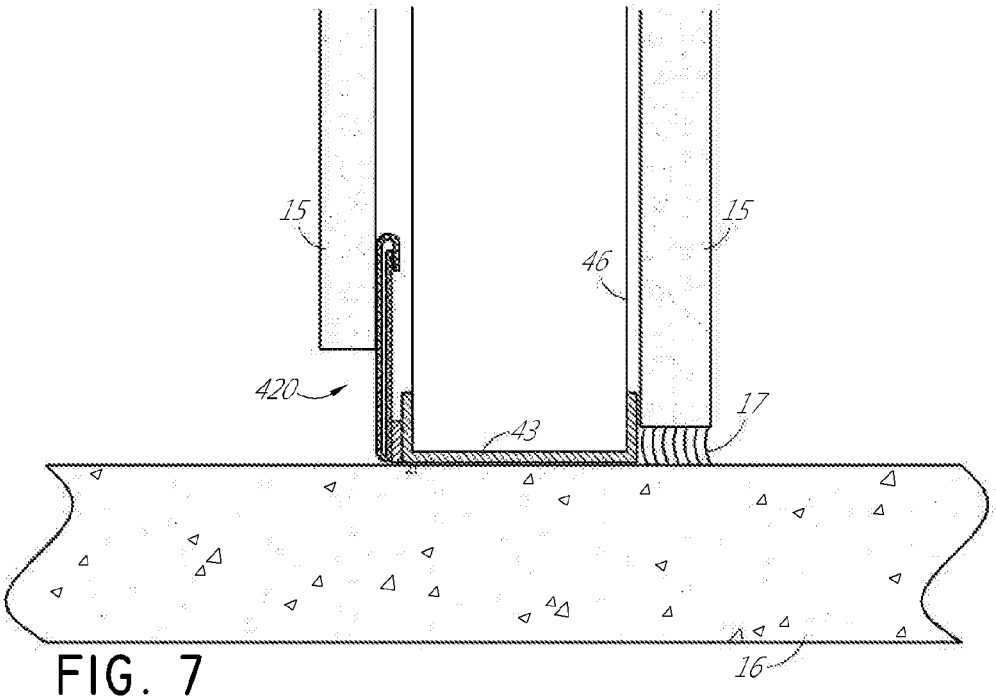
FIG. 7 is a cross-sectional view of a bottom-of-wall assembly incorporating another embodiment of a fire-rated reveal.
Figure 8:
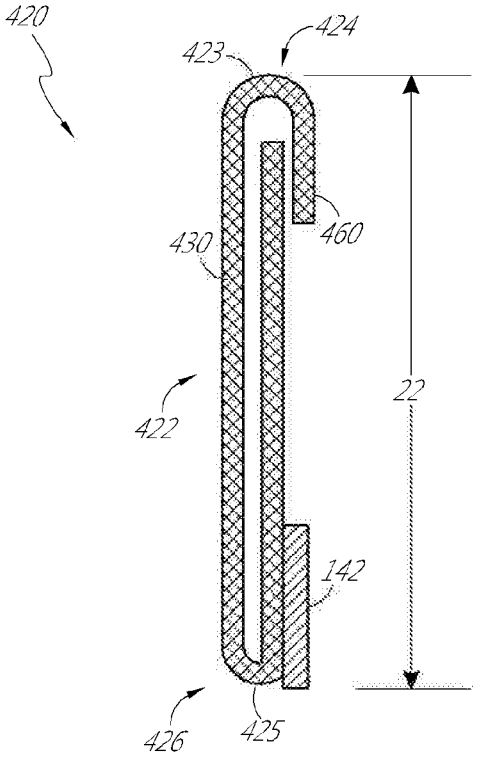
FIG. 8 is a side profile view of the fire-rated reveal shown in the wall assembly of FIG. 7.

Another embodiment of a reveal 420 is shown in FIGS. 7 and 8. FIG. 7 illustrates the reveal 420 incorporated as part of a bottom-of-wall assembly 110 and FIG. 8 illustrates the reveal 420 alone. The fire-rated reveal 420 is preferably used in a bottom-of-wall assembly as shown in FIG. 7. The reveal 420 is preferably separate from the bottom track to provide fire protection that can be installed along with the installation of the bottom track or installed after the installation of the bottom track to avoid the need to have the framers return after installation of the wall board. However, the reveal 420 may also be used in a head-of-wall assembly. Similar to the reveals 120, 220, and 320, the reveal 420 is preferably formed from a light gauge steel material by any suitable process, such as roll forming, for example. Preferably, the reveal 420 is an elongated member having a consistent or substantially consistent cross-sectional shape throughout its length. One or more preferred embodiments of the reveal 420 are generally or substantially strap or plate like in cross-section. In one embodiment, the reveal 420 may be between about 5 feet and 25 feet in length. The reveal 420 can also be between about 10 and 20 feet in length. Preferably, the reveal 420 is about 10-12 feet in length to facilitate shipping and storage. Additionally, the reveal 420, as well as reveals 120, 220, and 320, can be stacked and shipped without damaging the intumescent material more easily that than a header or bottom track that incorporates the intumescent material.

In some embodiments, the reveal 420 has a strap or plate profile, with the J-shaped drywall support profile shown in reveals 120, 220, and 320 removed. As the concrete floor is rarely perfectly straight, use of a strap or plate profile reveal can facilitate installation, allowing the installer to, for example, snap a level caulk line of the face of the steel strap or reveal as a reference point for the drywall location. Similar to the reveals 120, 220, and 320 discussed above, the reveal 420 includes a vertical reveal leg 422 forming a fire-blocking strap or plate. The reveal 420 also includes a hem 460 to help hold the reveal 420 in place as part of the wall assembly. The illustrated vertical leg 422 and hem 460 are unitarily formed by bending or shaping a single sheet of material, preferably steel. As described above, typically, the single piece of material is a flat piece of light gauge steel, which is then deformed into the shape of the reveal 420, such as through a roll-forming, bending (such as on a press brake) or other suitable process. Preferably, the vertical leg 422 is substantially planar.

With continued reference to FIG. 8, the reveal 420 is formed from metal sheet material 430 that is bent in a first direction to form a substantially 180 degree bend 423 at a first end 424 of the vertical leg 422 and bent in the same direction to form an approximately 180 degree bend 425 at a second end 426 of the vertical leg 422. The hem 460 is adjacent to the corner 434 at the first end 424 of the vertical leg 422 and extends vertically downward to a free end of the material 430.

With reference to FIG. 7, another embodiment of a bottom-of-wall assembly 110 is illustrated, incorporating the reveal 420 shown in FIG. 8. FIG. 7 illustrates a bottom-of-wall assembly similar to that shown in and described with reference to FIGS. 1 and 3. Accordingly, the same reference numbers are used to describe the same or corresponding components. The wall assembly 110 includes a bottom track 43 attached to a concrete floor 16. The reveal 420 is installed along with the bottom track 43 or after the bottom track 43. The bottom track 43 is configured to receive a plurality of metal wall studs, such as stud 46. Wallboard, such as drywall 15 is placed and secured alongside the reveal 420. Preferably, the wallboard 15 overlaps at least 2 inches of the vertical leg 422 of the reveal 420. As illustrated in FIG. 7, the opposite side of the wall does not incorporate a reveal 420 and the drywall 15 is fastened directly to the bottom track 43 and sealed with the concrete floor 16, such as with sealant 17. However, in other embodiments, the bottom-of-wall assembly 110 may include two reveals 420 with one reveal 420 on either side of the wall assembly 110. A mechanical fastener (not shown), such as a framing screw, can be used to attach the reveal 420 to the bottom track 43 and the metal stud 46.

Preferably, the vertical leg 422 of the reveal 420 is a two-ply or double layer construction of two layers of material. As noted above, the double layers of material forming the vertical leg 422 are beneficial for fire protection and for passing the UL fire-rating test.

During manufacture, the material 430 is bent, forming bend 425, to allow the material to extend upwards and form part of the two-ply section of the vertical leg 422. A free end of the metal sheet 430 extends vertically upward from the bend 425 at the second end 426 of the vertical leg 422, substantially parallel to the vertical leg 422. In some embodiments, as shown in FIG. 8, a free end of the material 430 is between the hem 460 and the vertical leg 422. In other embodiments, the free end of the material 430 could be located on the opposite side of the vertical leg 422.

With further reference to FIG. 8, in some embodiments a total width or height 22 of the reveal 420 is approximately 6 inches. In other embodiments, the total width or height of the reveal 420 may be between approximately 2 inches and approximately 8 inches, between approximately 3 inches and approximately 7 inches, or approximately 6 inches. Preferably, when installed as part of a wall assembly, as shown in FIG. 7, wallboard 15 overlaps the reveal 420 by approximately 2 inches.

As discussed above, since the reveal 420 is preferably made from a single sheet of material, the bending process to form the reveal 420 results in a two-ply, or double layer, section. As shown in FIG. 8, the vertical reveal leg 422 has at least a double layer along a majority of the length of the leg 422 to provide fire protection and pass UL fire rating tests. For further fire protection, intumescent material may be placed on an exterior surface of the reveal 420 or between layers of material forming the two-ply sections of the vertical leg 422 of the reveal 420. For example, as shown in FIG. 8, intumescent material 142, such as an intumescent strip or intumescent tape, may be placed on an exterior surface of the vertical leg 422 at the second end 426 and facing towards the track, such as bottom track 43, shown in FIG. 7. Preferably, the intumescent material 142 extends beyond and below the bend 425 such that it can seal against an irregular floor surface when unexpanded and, when exposed to heat, the intumescent material can expand and form a fire block. In some embodiments, including the embodiment shown in FIG. 8, the intumescent material 142 may be an intumescent tape having a width of approximately ⅝ inches. While one embodiment of the reveal 420 is shown in FIG. 8, the reveal 420 can take the shape of any of the reveals 120, 220, 320 discussed above.

Figure 9:
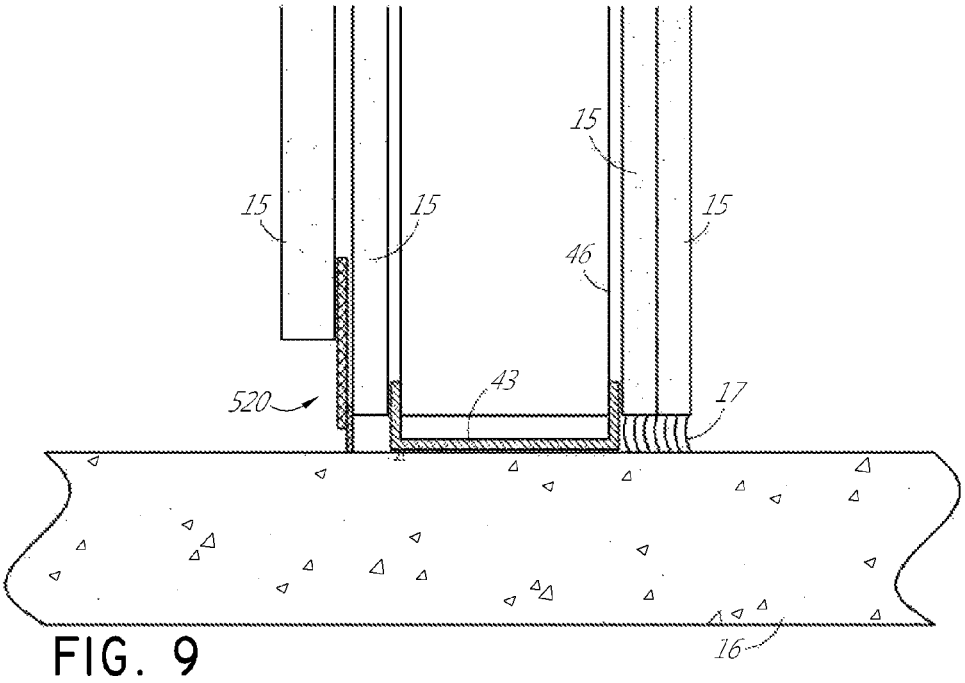
FIG. 9 is a cross-sectional view of a bottom-of-wall assembly incorporating another embodiment of a fire-rated reveal.
Figure 10:
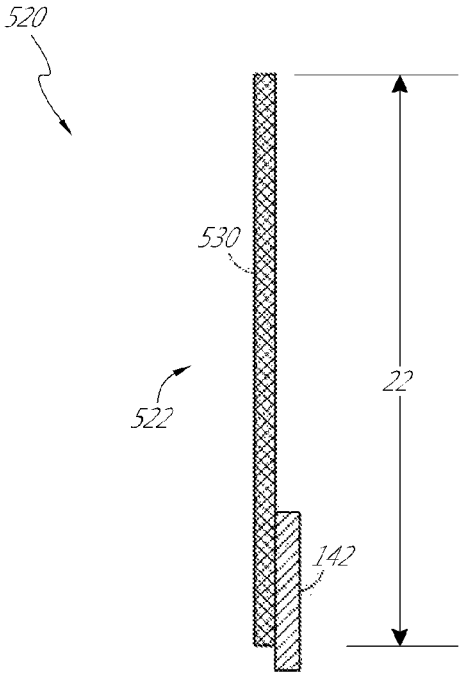
FIG. 10 is a side profile view of the fire-rated reveal shown in the wall assembly of FIG. 9.

FIGS. 9 and 10 illustrate another embodiment of a reveal 520 formed as a single layer or single ply strap. FIG. 9 illustrates the reveal 520 incorporated as part of a bottom-of-wall assembly 110 and FIG. 10 illustrates the reveal 520 alone. The fire-rated reveal 520 is preferably used in a bottom-of-wall assembly as shown in FIG. 9. The reveal 520 is preferably separate from the bottom track to provide fire protection that can be installed along with the installation of the bottom track or installed after the installation of the bottom track to avoid the need to have the framers return after installation of the wall board. However, the reveal 520 may also be used in a head-of-wall assembly. Similar to the reveals 120, 220, 320, and 420, the reveal 520 is preferably formed from a light gauge steel material by any suitable process, such as roll forming, for example. Preferably, the reveal 520 is an elongated member having a consistent or substantially consistent cross-sectional shape throughout its length. One or more preferred embodiments of the reveal 520 are generally or substantially strap or plate like in cross-section. In one embodiment, the reveal 520 may be between about 5 feet and 25 feet in length. The reveal 520 can also be between about 10 and 20 feet in length. Preferably, the reveal 520 is about 10-12 feet in length to facilitate shipping and storage. Additionally, the reveal 520, as well as reveals 120, 220, 320, and 420, can be stacked and shipped without damaging the intumescent material more easily that than a header or bottom track that incorporates the intumescent material.

In some embodiments, the reveal 520 has a strap or plate profile, similar to reveal 420, with the J-shaped drywall support profile shown in reveals 120, 220, and 320 removed. As the concrete floor is rarely perfectly straight, use of a strap or plate profile reveal can facilitate installation, allowing the installer to, for example, snap a level caulk line of the face of the steel strap or reveal as a reference point for the drywall location. Similar to the reveals 120, 220, 320, and 420 discussed above, the reveal 520 includes a vertical reveal leg 522 forming a fire-blocking strap or plate formed from a single sheet of material such as sheet metal. As described above, typically, the single piece of material is a flat piece of light gauge steel. Preferably, the vertical leg 522 is substantially planar.

With continued reference to FIG. 10, the reveal 520 is formed from metal sheet material 530. A fire-retardant material, such as an intumescent strip or tape 142 is applied to a bottom, interior facing surface of the vertical leg 522 as shown. Preferably, the intumescent material 142 extends beyond and bottom surface of the vertical leg 522 such that it can seal against an irregular floor surface when unexpanded and, when exposed to heat, the intumescent material can expand and form a fire block. In some embodiments, including the embodiment shown in FIG. 10, the intumescent material 142 may be an intumescent tape having a width of approximately ⅝ inches.

With reference to FIG. 9, another embodiment of a bottom-of-wall assembly 110 is illustrated, incorporating the reveal 520 shown in FIG. 10. FIG. 9 illustrates a bottom-of-wall assembly similar to that shown in and described with reference to FIGS. 1, 3, and 7. Accordingly, the same reference numbers are used to describe the same or corresponding components. The wall assembly 110 includes a bottom track 43 attached to a concrete floor 16. The wall assembly 110 includes two layers of wallboard, such as drywall 15. Preferably, a first layer of wallboard 15 is placed and secured alongside the track 43. The reveal 520 is installed alongside an exterior surface of the first layer of wallboard 15 as shown in FIG. 9. The bottom track 43 is configured to receive a plurality of metal wall studs, such as stud 46. A second layer of drywall 15 is placed and secured alongside the reveal 520. Preferably, the wallboard 15 overlaps at least 2 inches of the vertical leg 522 of the reveal 520, leaving a gap for a trim piece (not shown) to be installed flush with the outer surface of the layers of drywall 15, as shown in FIG. 3. As illustrated in FIG. 9, the opposite side of the wall does not incorporate a reveal 520 and the layers of drywall 15 are fastened directly to the bottom track 43 and sealed with the concrete floor 16, such as with sealant 17. However, in other embodiments, the bottom-of-wall assembly 110 may include two reveals 520 with one reveal 520 on either side of the wall assembly 110. A mechanical fastener (not shown), such as a framing screw, can be used to attach the reveal 520 to the bottom track 43 and the metal stud 46. As shown, the wall assembly 110 is a two-hour fire-rated static bottom-of-wall joint assembly, due to the two layers of wallboard used on either side of the wall. The two layers of drywall 15 may provide sufficient fire protection such that a single ply reveal, such as the reveal 520 may be used in this type of wall joint to provide fire-blocking protection.

With further reference to FIG. 10, in some embodiments a total width or height 22 of the reveal 520 is approximately 6 inches. In other embodiments, the total width or height of the reveal 520 may be between approximately 2 inches and approximately 8 inches, between approximately 3 inches and approximately 7 inches, or approximately 6 inches. Preferably, when installed as part of a wall assembly, as shown in FIG. 9, wallboard 15 overlaps the reveal 520 by approximately 2 inches.

The above-described arrangements can also be utilized at a gap at the bottom of the wall assembly and at a gap at the side of the wall assembly. Preferably, each such assembly is similar to the head-of-wall assemblies described above. In particular, preferably, each such assembly creates a fire-resistant structure at the respective wall gap. Any of the embodiments of a reveal discussed above can be attached adjacent to a corner, flange, or leg of a framing member, such as metal tracks, headers, header tracks, sill plates, bottom tracks, metal studs, wood studs or wall partitions, and placed between the framing member and a wall board member at a perimeter of a wall assembly to create a fire block arrangement.

The described assemblies provide convenient and adaptable fire block structures for a variety of linear wall gap applications, which in at least some embodiments permit the creation of a fire rated joint according to UL 2079. In some arrangements, the separate angles and reveal pieces include fire-retardant materials (e.g., intumescent material strips) secured (e.g., adhesively attached or bonded) to appropriate locations on the angles or reveal pieces and can be used with a variety of headers, footers (bottom tracks or sill plates) and studs to create a customizable assembly. Thus, one particular type of angle or reveal can be combined with multiple sizes or types of base tracks, headers, sill plates or studs to result a large number of possible combinations. The angles and reveals can be configured for use with commonly-available tracks, headers, sill plates or studs, in addition to customized tracks, headers, sill plates or studs specifically designed for use with the angles. Thus, the advantages of the described systems can be applied to existing wall assemblies. Therefore, the angles and reveals can be stocked in bulk and used as needed with an appropriate framing component.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present angle piece and assemblies have been described in the context of particularly preferred embodiments, the skilled artisan will appreciate, in view of the present disclosure, that certain advantages, features and aspects of the angle and reveal pieces and assemblies may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. For example, the specific locations of the intumescent strips can be utilized with the variety of different embodiments of the angle and reveal pieces disclosed herein in addition to those embodiments specifically illustrated. Thus, it is intended that the scope of the present invention herein disclosed should not be limited by the particular disclosed embodiments described above, but should be determined only by a fair reading of the claims.

What is claimed is:

1. A fire-rated wall joint reveal product configured to cover a gap between a wallboard and an adjacent structure, the reveal is positioned between the stud wall and a stud wall facing surface of the wallboard, the reveal comprising:

an elongate strap piece comprising a first free end and a second free end, a first bend and a second bend positioned between the first free end and the second free end, the first and second bends disposed at opposite ones of an upper edge and a lower edge of the strap piece, the first bend defining the upper edge of the strap piece in use, the first bend and the second bend defining a first vertical leg portion and a second vertical leg portion forming a gap therebetween, the first and second vertical leg portions being formed from a single piece of material, wherein, in cross-section, at least a portion of the first vertical leg portion horizontally overlaps a portion of the second vertical leg portion such that the first and second vertical leg portions extend between the stud wall and the stud wall facing surface of the wallboard, and the first and second vertical leg portions cover the gap between the wallboard and the adjacent structure; and a heat-expandable intumescent strip attached to the strap piece and extending lengthwise along a surface of the strap piece configured to face the stud wall in use, the intumescent strip adjacent the second bend.

2. The fire-rated joint reveal product of claim 1, wherein the strap further comprises a second intumescent material applied to one of the first vertical leg portion and the second vertical leg portion such that the second intumescent material is between the first vertical leg portion and the second vertical leg portion.

3. The fire-rated joint reveal product of claim 1, wherein the strap further comprises a hem defined between the first bend and the first free end, the hem substantially parallel to the first and second vertical leg portions.

4. The fire-rated joint reveal product of claim 3, wherein the first and second vertical leg portions and the hem are each planar and substantially parallel to each other.

5. The fire-rated joint reveal product of claim 3, wherein the first and second vertical leg portions and the hem are formed from a single piece of material.

6. The fire-rated joint reveal product of claim 1, wherein the strap further comprises a wallboard support defined between the first bend and the first free end, the wallboard support having a substantially J-shaped profile and extending outwards from the first and second vertical leg portions.

7. The fire-rated joint reveal product of claim 1, wherein the strap further comprises a kickout portion such that the kickout portion forms an approximately 100 degree angle with the first and second vertical leg portions.

8. The fire-rated joint reveal product of claim 1, wherein, in use, the strap is positioned adjacent to one of a first flange and a second flange of a track structure of a wall assembly such that the intumescent strip is between the strap and one of the first flange and the second flange of the track.

9. The fire-rated wall joint reveal product of claim 1, wherein the single piece of material comprises a metal material.

10. The fire-rated wall joint reveal product of claim 1, further comprising a third vertical leg portion, wherein, in cross-section, a portion of each of the first, second and third vertical leg portions horizontally overlap.

11. The fire-rated wall joint reveal product of claim 10, wherein the first, second and third vertical leg portions are formed from a single piece of material.

12. A fire-rated wall joint reveal product configured to cover a gap between a wallboard and an adjacent structure, wherein the reveal is positioned between the stud wall and a stud wall facing surface of the wallboard, the reveal comprising:

an elongate strap piece comprising a first free end and a second free end, a first bend positioned between the first free end and the second free end, the first bend positioned between a first vertical leg portion and a second vertical leg portion, a second bend positioned between the first bend and the second free end, the first and second bends disposed at opposite ones of an upper edge and a lower edge of the strap piece, the second bend defining a third vertical leg portion, the first, second and third vertical leg portions being formed from a single piece of material, wherein, in cross-section, a portion of each of the first, second and third vertical leg portions horizontally overlap such that, in use, the first, second and third vertical leg portions extend between the stud wall and the stud wall facing surface of the wallboard, and the first and second vertical leg portions cover the gap between the wallboard and the adjacent structure.

13. The fire-rated wall joint reveal product of claim 12, wherein the first and second vertical leg portions are each planar and substantially parallel to each other.

14. The fire-rated wall joint reveal product of claim 12, further comprising a first heat-expandable intumescent strip attached to the strap piece and extending lengthwise along a stud wall-facing surface of the strap.

15. The fire-rated wall joint reveal product of claim 14, further comprising a second heat-expandable intumescent strip positioned between adjacent third vertical leg portions.

16. The fire-rated wall joint reveal product of claim 12, wherein the single piece of material comprises a metal material.

* * * * *